US005473141A

United States Patent [19]

Makris et al.

[11] Patent Number: 5,473,141

[45] Date of Patent: Dec. 5, 1995

[54] RADIANT TUBE HEATING ASSEMBLY

[75] Inventors: Angelo Makris, Southbury; George Novy, Danbury, both of Conn.

[73] Assignee: The Kanthal Corporation, Bethel, Conn.

[21] Appl. No.: 141,030

[22] Filed: Oct. 26, 1993

[51] Int. Cl.[6] ..... H05B 3/10

[52] U.S. Cl. ..... 219/544; 219/538; 219/552; 338/235; 373/133; 373/117

[58] Field of Search ..... 219/544, 550, 219/542, 539; 373/117, 132, 133, 134; 338/234–237

[56] References Cited

U.S. PATENT DOCUMENTS 3,660,049 5/1972 Benjamin ..... 29/182.5
4,233,494 11/1980 Pawlik et al. ..... 219/539
4,542,513 9/1985 Inoue ..... 373/117
5,083,012 1/1992 Edwards ..... 219/553
5,282,221 1/1994 Benedict et al. ..... 219/542

*Primary Examiner*—Teresa J. Walberg
*Assistant Examiner*—Sam Paik
*Attorney, Agent, or Firm*—Lawrence Hager

[57] ABSTRACT

A radiant tube heating assembly for a furnace, which assembly combines the features of a heating element utilizing the latest powder metallurgical technology, improved ceramic spacers and staggered weld joints to thereby enable higher efficiency and heating temperatures. Further, the assembly enables a higher temperature element system, ease of manufacture and reduced failures due to shorts or arc over at the weld joints.

6 Claims, 3 Drawing Sheets

RADIANT TUBE HEATING ASSEMBLY

FIELD OF INVENTION

This invention relates to relatively high temperature electric furnaces and, more particularly, to a radiant tube assembly having improved construction and function.

BACKGROUND OF THE INVENTION

Typically, radiant tube heating units utilize a heating element rod alloy formed by melting several metals together and interconnecting a plurality of such rods to form a series circuit current path. The connections are made at one or both ends of the tube by juxtaposed weld joints. Due to the weld process, the spacing between weld joints is reduced which facilitates electrical arc over and, consequently, unit failures.

Heretofore, the prior art support systems and weld techniques and heating element rods have not been successful in eliminating the problems of sagging, arc shorting, and insulation break-down which resulted in high unit failure and costly shutdowns.

BRIEF STATEMENT OF THE PRIOR ART

The prior art includes numerous types of furnaces, electric radiant tube heaters and heating elements.

The prior art is also replete with attempts to circuit design the electric heating elements in such a way as to eliminate element failure while enabling easy assembly and cost effective manufacture.

One such attempt, shown in U.S. Pat. No. 5,083,012 issued Jan. 21, 1992 to Robert H. Edwards shows a design technique which relies on a watt-loading or watt-density calculation to determine the length/diameter/current capacity characteristics for a heating rod, with the heating resistance wires being connectable in parallel to a preselected given voltage source. The connections between wires or rods being in close juxtaposition with other rod connections. Thus this patent reference does not show or describe a method/assembly for reducing arc-over shorting or the use of improved powder metallurgical formed heating rods or improved insulation techniques.

Another prior art patent of interest with regard to the present invention is U.S. Pat. No. 1,654,314 issued Feb. 5, 1927 to R. X. Tuttle. This reference describes a base member having outwardly diverging arms. A threaded post is mounted on each arm. Loosely arranged on the posts are cores. Resistance coils are wound upon the cores. Apparent shortcomings of this therapeutic lamp device construction are that it is unsuitable for use in a furnace environment and requires relatively complex, numerous components laborious to assemble.

Other prior art patents of some interest include U.S. Pat. Nos. 1,654,313 Dec. 27, 1927 to R. X. Tuttle, 1,718,106 issued Jun. 18, 1929 to S. S. Bolsinger; 1,693,133 issued Nov. 27, 1928 to P. R. G. Bredermann; 1,535,901 issued Apr. 28, 1925 to W. Clark; 1,459,307 issued Jun. 19, 1923 to C. A. Laise et al; 1,358,219 issued Nov. 9, 1920 to E. T. Lancaster; 4,417,346 issued Nov. 22, 1983 to Roger R. Giler; and 4,007,369 issued Feb. 8, 1977 to Wolfgang Dietye.

These patents are mentioned as being representative of the prior art and other pertinent patents/references may exist. None of the above cited patents are deemed to affect the patentability of the present claimed invention.

In contrast to the prior art, the present invention provides an improved heating unit assembly for an electric type furnace which utilizes a high temperature powder metallurgical alloy used to construct the heating rod elements. The heating element(s) are mounted to ceramic insulators which support the rod elements in such a way as to substantially eliminate the common problems, i.e. bunching, creeping and sagging etc., of the prior art. Further, the present invention incorporates a staggered welding system to substantially reduce shorts due to arc-over and, thereby, reduces system failure and enables higher operating voltage/power per heater size, and substantially without element failure due to sagging and short-outs.

SUMMARY OF THE INVENTION

Generally speaking, the invention comprises a modular radiant tube heating assembly having a ceramic support system with improved functionaries and improved structural integration.

The radiant heating tube basically comprises: a plurality of spaced apart heating rods of a powder metallurgical alloy of iron-chromium-aluminum or other suitable ferric alloy made by powder metallurgical technology, a plurality of ceramic like mounting spacers for holding said elongate rods generally in spaced parallelism, and plurality of staggered weld joints between pairs of juxtapositioned heating rods to form an electrical circuit amongst the heating rod elements.

OBJECTIVES

Accordingly, an object of the invention is to provide a new and improved radiant tube heating unit for an electric type furnace.

It is a further object of the invention to provide a radiant tube heater having an improved assembly.

It is a further object of the invention to provide a radiant tube heater assembly which utilizes a new and improved mechanism formed of ceramic.

It is a further object of the invention to provide an improved assembly which enables the heating elements to be spaced relatively proximal from each other for improved heater function to heater size.

It is a further object of the invention to provide heating elements formed of high temperature powder metallurgically formed alloy.

It is a further object of the invention to provide an improved mounting assembly to facilitate low cost assembly and disassembly, i.e. replacement, of each heating element.

It is a further object of the invention to provide a new and improved heating assembly which enables operation at relatively high temperatures with relatively few burn-outs or malfunctions.

It is a further object of the invention to provide an electric furnace modular radiant tube heating assembly at relatively low cost.

Another object of the invention is to provide an improved radiant tube heating unit assembly which uses a staggered welding circuit connection between heating rods.

Another object of the invention is to provide an improved radiant tube heater assembly which virtually eliminates electrical arc shorts between weld spots.

Yet another object of the invention is to provide a new and improved type insulator disk for a radiant tube type heater.

Other objects and advantages will be apparent to those skilled in the art from the detailed description of the drawings.

BRIEF DESCRIPTION OF THE DRAWINGS

The accompanying drawings illustrate the preferred embodiment of the present invention by way of example. Like numerals refer to like parts throughout.

DETAILED DESCRIPTION OF THE INVENTION

Figure 1:
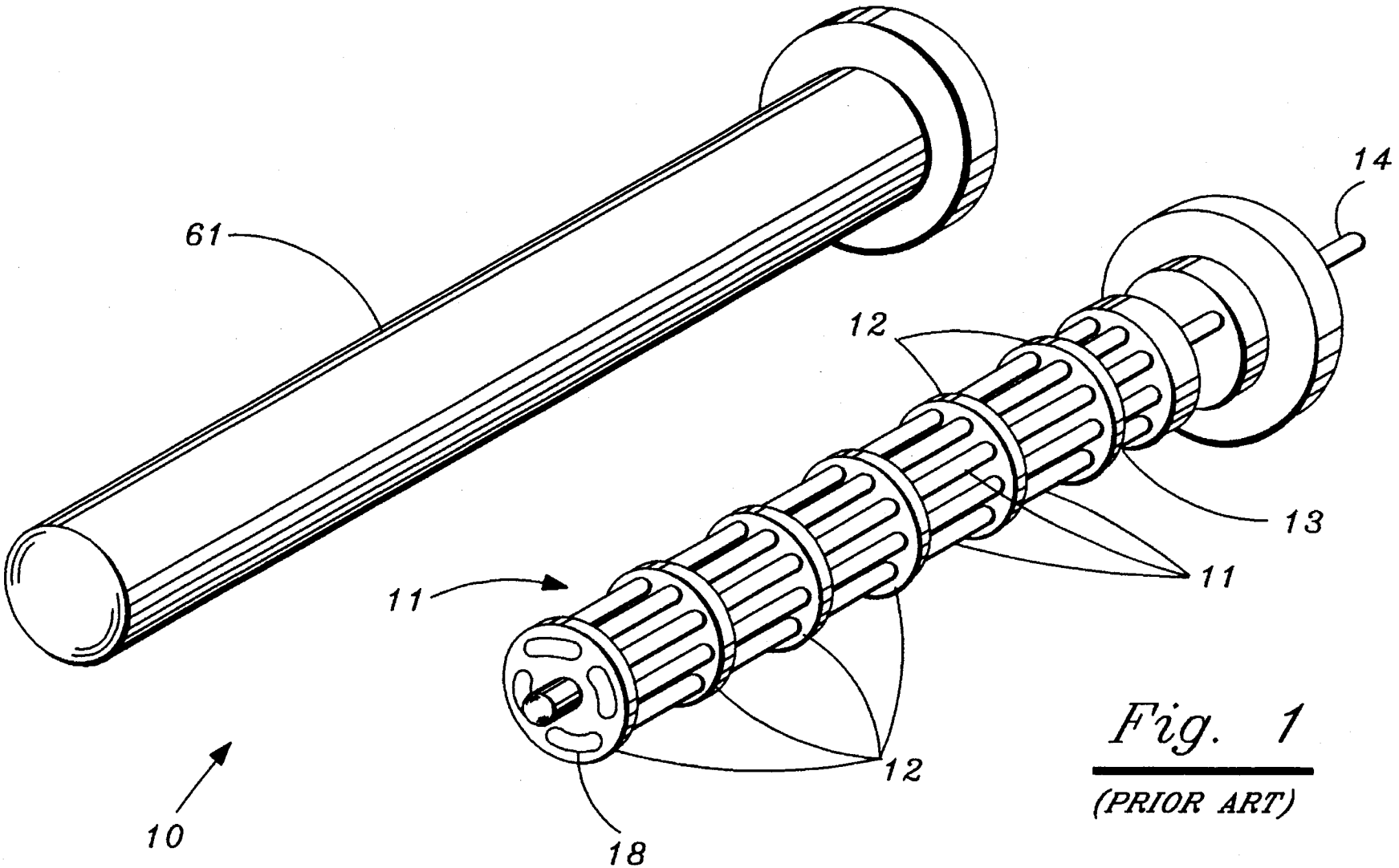
Fig. 1 (PRIOR ART)
FIG. 1 is an illustrative view of a prior art radiant tube.
Figure 2:
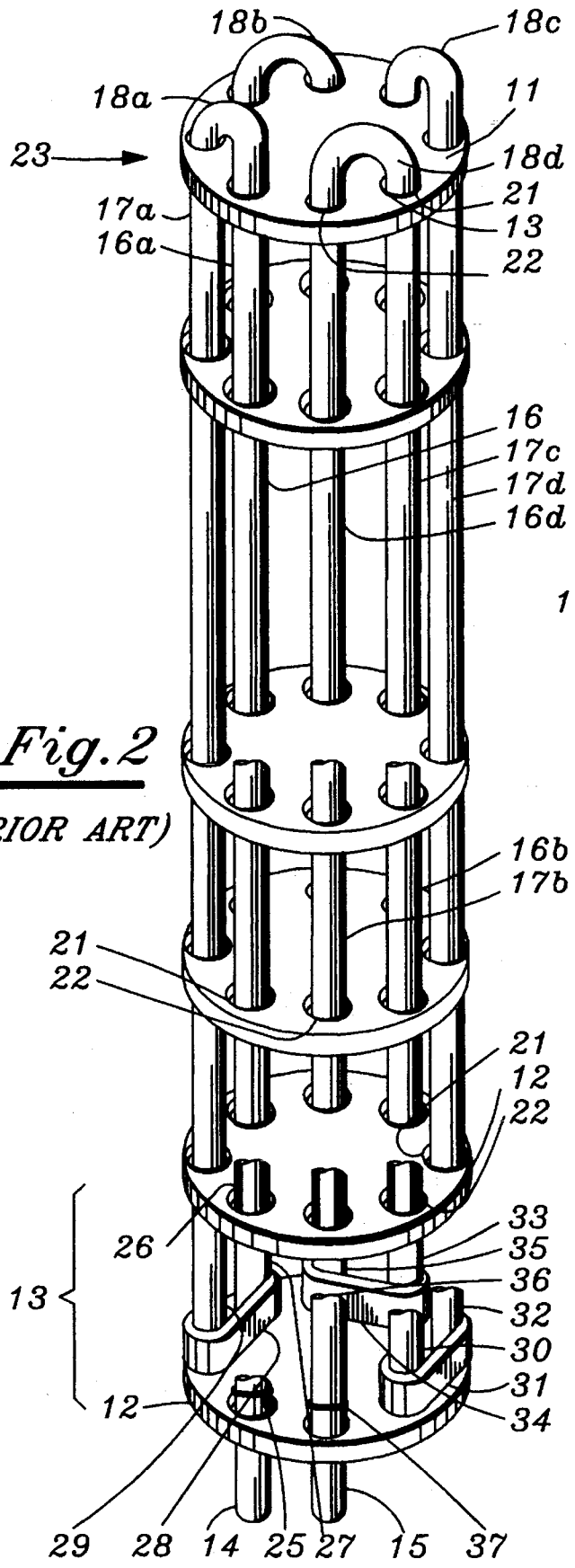
Fig. 2 (PRIOR ART)
FIG. 2 is an exploded perspective plan view of the circuit forming welds between the prior art heating rods similar to that illustrated in FIG. 1.
Figure 3:
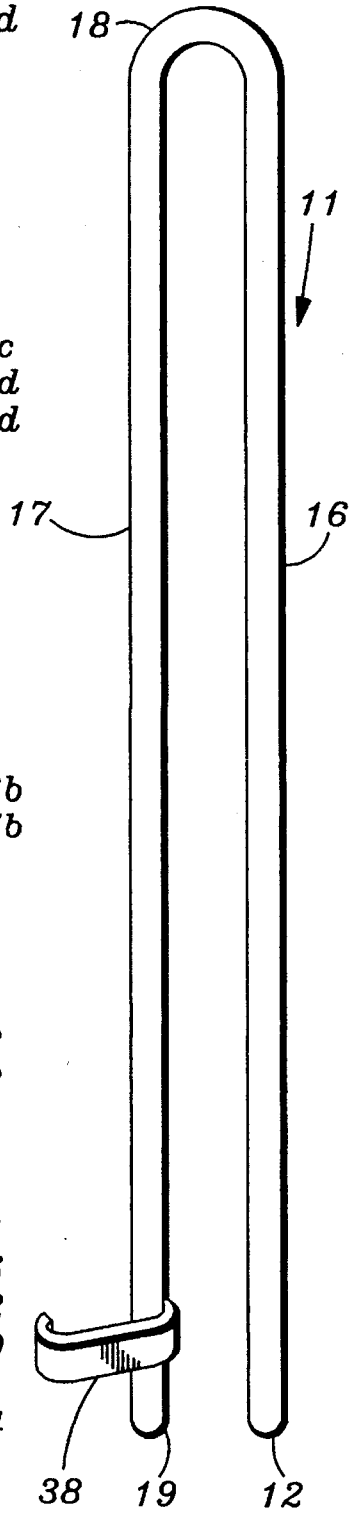
Fig. 3 (PRIOR ART)
FIG. 3 is a perspective view of a standard type heating element used in radiant tube heaters.

Referring now to the drawings, particularly FIGS. 1, 2, and 3, there is shown a radiant tube heating unit 10 of conventional design.

Basically speaking, such heating units 10 comprise a plurality of "U" shaped heating elements 11 arranged in a pattern and supported along the rod lengths by a plurality of ceramic spacer discs 12. The rods are interconnected at the bottom end section 13 by welding to form an electrical series circuit. A first terminal 14 and a second terminal 15 are provided for coupling an electrical power source (not shown) to the terminals 14, 15 of the heating unit 10. As can be seen more clearly in FIG. 2, each heating element 11 typically comprises two bar or rod members 16, 17 integrally formed from a single elongate bar which is bent 18 at an intermediate section. Each heating element 11 is then mounted onto a plurality of support discs 12 in a manner similar to that illustrated in FIGS. 1 and 2. That is, the free ends 19, 20 are inserted through aligned holes 21, 22 formed in each respective support disc 12 with the bent sections 18 being at the top end 23 of the heating unit 10.

Typically, the heating elements are formed of an iron base alloy by melting, for example, iron-chromium-aluminum together to form the alloy heating element 11. Prior art type heating elements and ceramic spacer discs are shown in U.S. Pat. No. 5,083,012 previously discussed. The prior art spacer discs 12 generally contain about 50% alumina and substantial amounts of SiO2.

It has now been discovered that frequent failure of the prior art radiant tube heating units is caused by the free SiO2 content being too high which, at the temperatures for example 1200 degrees Celsius experienced in such heating tubes, causes a reaction to occur with the alumina oxide on the surface of the heating elements 11.

It has also been discovered that failures have occurred in the prior art radiant tube heating units from rod 16, 17 bunching or creeping, i.e., shorting together.

With particular reference now to FIG. 2, the method of forming the prior art circuitry of the heating elements is illustrated. Generally speaking, the rods 16, 17 of each element 11 are interconnect to form a series circuit having to terminals 14, 15 for connecting a power source to. Terminal 14 is welded 25 to one end 26 of a first rod 16. This rod is connected via a bent section 18*a* to rod 17*a*. The bottom end 27 of rod 17*a* is welded 28 to the bottom end 29 of rod 16*b*, which is integrally connected to rod 17*b* via bent section 18*b*. The bottom end 30 of rod 17*b* is welded 31 to the bottom end 32 of rod 16*c*, which is integrally connected to rod 17*c* via bent section 18*c*. The bottom end 33 of rod 17*c* is welded 34 to the bottom end 35 of rod 16*d*, which is integrally connected to rod 17*d* via bent section 18*d*. The bottom end 36 of rod 17*d* is welded 37 to terminal 15 to complete the series circuit.

It is now recognized and discovered that numerous failures occurred in the prior art heating units as a result of electrical shorts between the weld joints 25, 28, 31, 34, and 37. In addition, these prior art units presented difficulty in and relatively expensive manufacture due to the cramped area 13 in which such large weld joints (which may include coupling plates 38) were heretofore provided in.

Figure 4:
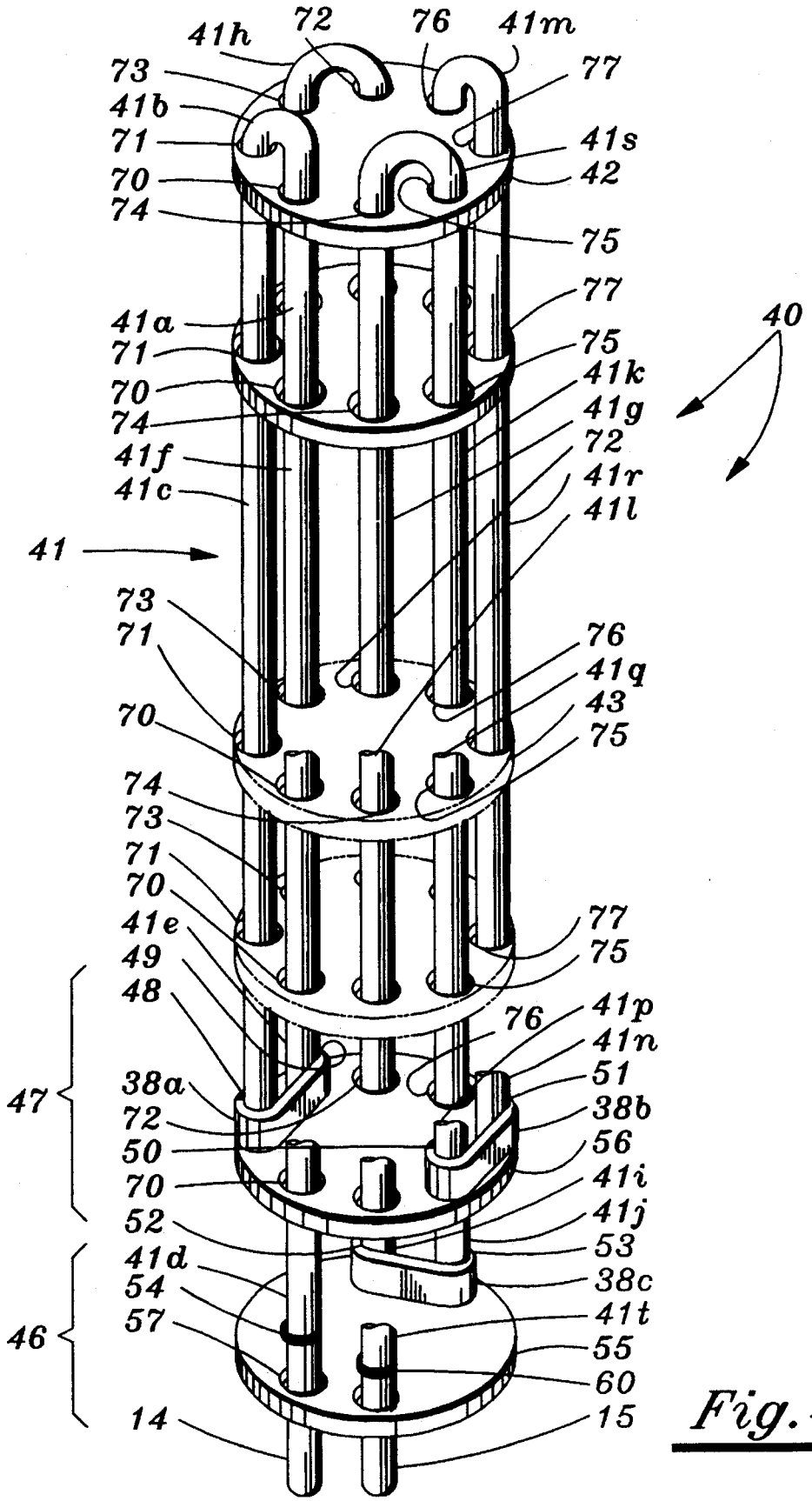
FIG. 4 is a simplified illustrative plan view of a radiant tube heater having staggered weld joints at one end of the unit to form an electrical series circuit in accordance with the present invention.

With reference now to FIG. 4, an illustrative plan view of a first embodiment 40 of the present invention is depicted. Basically speaking a plurality of heating elements 41 are mounted on a plurality of support discs in similar manner to the prior art radiant tube heating units. The intermediate bent sections 41*b*, 41*h*, 41*m*, 41*s*, are all disposed atop the uppermost support disc 42, with at least one or more intermediate support discs 43 mounted along the length of the heating rods 41*a*, 41*c*, 41*f*, 41*g*, 41*k*, 41*b*, 41*q*, 41*l*, As can be readily seen by reference to FIG. 4, one feature of the present invention is to interconnect the heating rods at spaced apart intervals or sections 46, 47 of the heating unit 40. In this manner, the coupling clips 38*a*–38*c* and weld joints 48–53 are relatively distally spaced apart. In this manner, the possibility of electrical shorts between weld joints is virtually eliminated or substantially reduced.

Terminal 14 is welded 54 to rod 41*a* between support discs 55 and 56, with its bottom end projecting through hole 57 in disc 55. Rod 41*a* is interconnected via bent section 41*b* to rod section 41*c*. Rod section 41*c* being shorter in length than rod section 41*a*, whereby its end portion 41*d* lies between support discs 44 and 56. Rod end portion 41*d* is welded 48 to one end of connector clip 38*a*, which is in turn welded 49 at its other end to the bottom end 41*e* of rod 41*f*. Rod 41*f* is integrally connected to rod 41*g* via bent portion 41*h*. The bottom end 41*i* of rod 41*g* being connected to end section 41*j* of rod 41*k* via connector clip 38*c* and weld joints 52, 53. Rod 41*k* is integrally connected to rod 41*e* via bent section 41*m*. The bottom end 41*n* of rod 41*r* is connected to end section 41*p* via connector clip 38*b* and weld joints 50, 51. Rod 41*q* is integrally connected to rod 41*l* via bent section 41*s*. Rod 41*l* being of longer length than rod 41*r*, whereby its bottom end 41*t* lies between parallel discs 55 and 56. Terminal 15 is welded 60 to bottom end 41*t* of rod 41*r* at an intermediate position between parallel support discs 55 and 56. In this manner, the welded connections between the various rod members are longitudinally distributed, for example, at different spaced apart section 46, 47, so that the lateral distance between welded members may be relatively increased to substantially reduce electrical shorting there between and to facilitate ease of manufacture.

As noted above, it has been discovered that at high temperatures the insulative quality of the typical ceramic discs 12 as used in the prior art breakdown and resulting electrical shorts or leakage occurs.

In accordance with a feature of the present invention, a new and improved ceramic support disc 42, 43, 55, 56, is provided. Ceramic support disc 42, 43, 55, 56, is formulated/manufactured to have a relatively high content of alumina, for example about 70%, and a relatively low SiO2 content.

Thus, the relative constituent elements of the new ceramic support discs have been reconstituted based on empirical tests of ceramic discs within a radiant tube heater to obtain the desired results, i.e., relatively few shorts or breakdown.

Another feature of the present invention is the use of heating elements 41 which are formulated/produced by means of powder metallurgy, for example, of iron-chromium-aluminum. Use of such heating elements within radiant tube furnace type heaters 40 enables operation up to 1400 degrees C continuous temperature with relatively few or virtually no bunching or creeping, i.e. maintaining its form stability and can be loaded up to 4 Watts/cm squared. Thus, substantial improvement is achieved by use of a heating element 41 produced by means of powder metallurgy. Such elements are commercially available under the name of "TUBOTHAL" elements from the Kanthal Corporation.

From the above it should now be recognized that an important feature of the present invention is the combination of such high temperature heating elements or rods with a new and improved ceramic support and welding system/assembly.

As with the prior art radiant tube heaters, a cover or tube 61 (see FIG. 1) may be utilized. Such radiant protective cover tubes 16 are commercially available from the Kanthal Corporation under the name of "APM" tubes.

What is claimed is:

1. A radiant tube heating assembly for use in an electric furnace, comprising:

a plurality of insulating support discs each having wall portions defining a plurality of holes, said support discs being longitudinally spaced apart with the holes in each support disc being aligned;

a plurality of heating elements (41) each having a bent portion (41*b*, 41*h*, 41*n*, 41*s*) and two spaced apart substantially parallel rods of unequal length (41*a* and 41*c*, 41*f* and 41*g*, 41*k* and 41*r*, 41*l* and 41*q*), a long first rod (41*a*) being welded (54) at a terminal end (41*v*) at a first longitudinal region (46) to a first electrical terminal (14), said first rod projects upwardly through a hole (70) in said plurality of substantially parallel spaced apart support discs, said first rod (41*a*) being integrally formed with and connected to a short second rod (41*c*) via a bent section (41*b*), said second rod (41*c*) projecting downwardly through a hole (71) in at least one of said plurality of support discs, said second rod (41*c*) being shorter in length than said first rod (41*a*) with a terminal end (41*d*) being disposed in a second longitudinal region (47), said terminal end (41*d*) of said first rod (41*a*) being welded (48, 49) to a free end (41*e*) of a short third rod (41*f*), said third rod (41*f*) projecting upwardly through a hole (73) in at least one of a plurality of said support discs, said third rod (41*f*) being integrally formed with and connected via a bent section (41*h*) to a long forth rod (41*g*), said forth rod being of greater length than said third rod and projecting downwardly through at least one of said aligned holes (72) and with a terminal end (41*i*) being disposed in said first region (46) of said tube heating assembly, the above weld interconnection of heating rods is repeated until a last remaining long rod terminal end (41*t*) is welded (60) to a second electrical terminal (15) in said first region (46), such that at least one of said insulating support discs (56) being interposed between a long rod (41*a*,41*l*) terminal end (41*v*,41*t*) disposed within said first region (46) and a short rod (41*c*,41*f*,41*r*,41*q*) terminal end (41*d*,41*e*,41*p*,41*m*) disposed within said second region (47); and a cover tube (61) dimensioned for receiving said heating assembly of heating elements and support discs, said cover tube being formed of a suitable alloy.

2. A radiant tube heating assembly, as in claim 1, wherein:

the heating elements comprise an alloy of iron-chromium-aluminum.

3. A radiant tube heating assembly as in claim 1, wherein:

the support discs include approximately 70% alumina and 30% ceramic material.

4. A radiant tube heating assembly as in claim 1, wherein:

the plurality of heating elements are interconnected in a series circuit.

5. A radiant tube heating assembly as in claim 1, wherein:

at least one support disc (56) is disposed longitudinally between at least two of said weld joints (48,52) so as to substantially reduce shorts there between.

6. A radiant tube heating assembly as in claim 1, wherein:

the heating elements consist of a hiqh temperature powder metallurgical alloy.

* * * * *